United States Patent [19]

Schultz

[11] Patent Number: 4,637,801

[45] Date of Patent: Jan. 20, 1987

[54] THRUST ENHANCING PROPELLER DUCT ASSEMBLY FOR WATER CRAFT

[75] Inventor: William C. Schultz, Chula Vista, Calif.

[73] Assignee: William H. Flood, Chula Vista, Calif. ; a part interest

[21] Appl. No.: 661,213

[22] Filed: Oct. 15, 1984

Related U.S. Application Data

[63] Continuation-in-part of Ser. No. 630,329, Jul. 12, 1984, abandoned.

[51] Int. Cl.[4] ..... B63H 5/15

[52] U.S. Cl. ..... 440/67; 416/189

[58] Field of Search ..... 440/66, 67, 71, 72; 114/166; 416/179, 181, 189, 247 A; 60/221

[56] References Cited

U.S. PATENT DOCUMENTS

| | | | |
|---|---|---|---|
| 945,553 | 1/1910 | Kovacs | 440/67 |
| 2,299,400 | 10/1942 | Marler | 114/166 |

FOREIGN PATENT DOCUMENTS

| | | | |
|---|---|---|---|
| 490527 | 1/1926 | Fed. Rep. of Germany | 440/67 |
| 1387903 | 12/1965 | France | 440/67 |
| 147473 | 10/1954 | Sweden | 440/71 |
| 1330 | of 1879 | United Kingdom | 114/166 |

*Primary Examiner*—Sherman D. Basinger

*Attorney, Agent, or Firm*—Keith D. Beecher

[57] ABSTRACT

A propeller duct assembly for use on water craft which enhances the thrust of the propeller, increases fuel efficiency, stabilizes boat handling, serves as a safety factor for swimmers, and which also serves to protect the propeller against submerged objects.

9 Claims, 10 Drawing Figures

FIG. 4
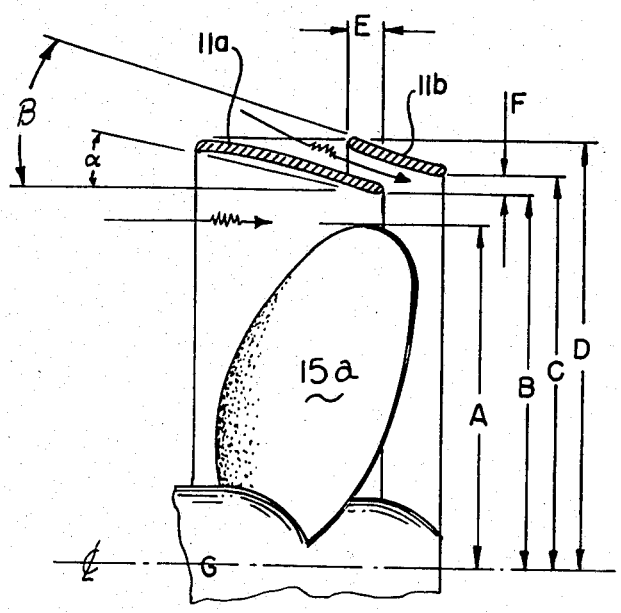
FIG. 5
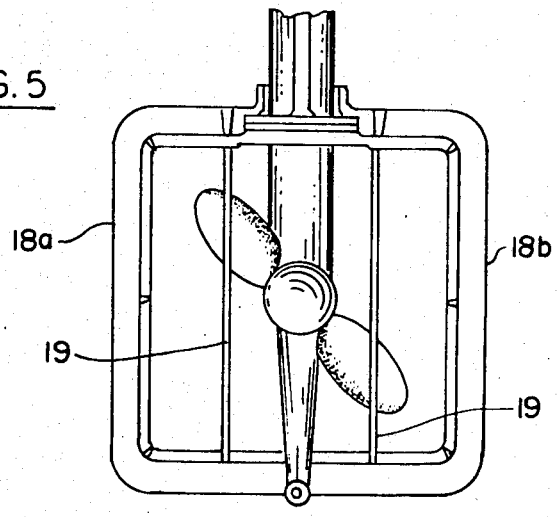
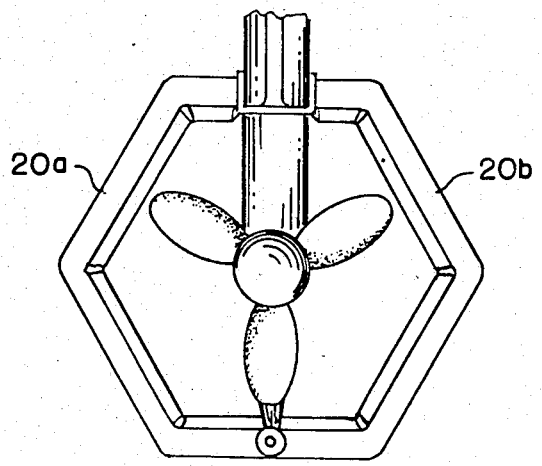
FIG. 6

THRUST ENHANCING PROPELLER DUCT ASSEMBLY FOR WATER CRAFT

This application is a continuation-in-part of copending application Ser. No. 630,329, filed July 12, 1984, now abandoned.

BACKGROUND OF THE INVENTION

The main objective of the invention is to provide such a propeller duct for water craft which is thrust enhancing, in that in cooperation with the rotating propeller creates a substantial increase in the propulsive thrust and towing efficiency of the craft.

Many serious accidents have occurred to persons water skiing or swimming in the vicinity of the exposed propellers of water craft, and another objective of the present invention is to provide a propeller duct which effectively prevents such accidents.

A further objective is to provide such a propeller duct which may be easily attached to the shaft housing of present-day outboard motors, or to the stern drive of present-day inboard motors.

Yet another objective of the invention is to provide such an improved propeller duct which may be fabricated from inexpensive resilient material.

BRIEF DESCRIPTION OF THE DRAWINGS

FIG. 4 is a cross-sectional view of a portion of the propeller duct of FIG. 1 showing the configuration geometry of the cowling of the particular guard;

FIG. 5 is a rear elevational view of a propeller duct constructed in accordance with a second embodiment of the invention to have a square configuration;

FIG. 6 is a rear elevational view of a propeller duct constructed in accordance with yet another embodiment of the invention and having a hexagonal configuration;

DETAILED DESCRIPTION OF THE ILLUSTRATED EMBODIMENTS

Figure 1:
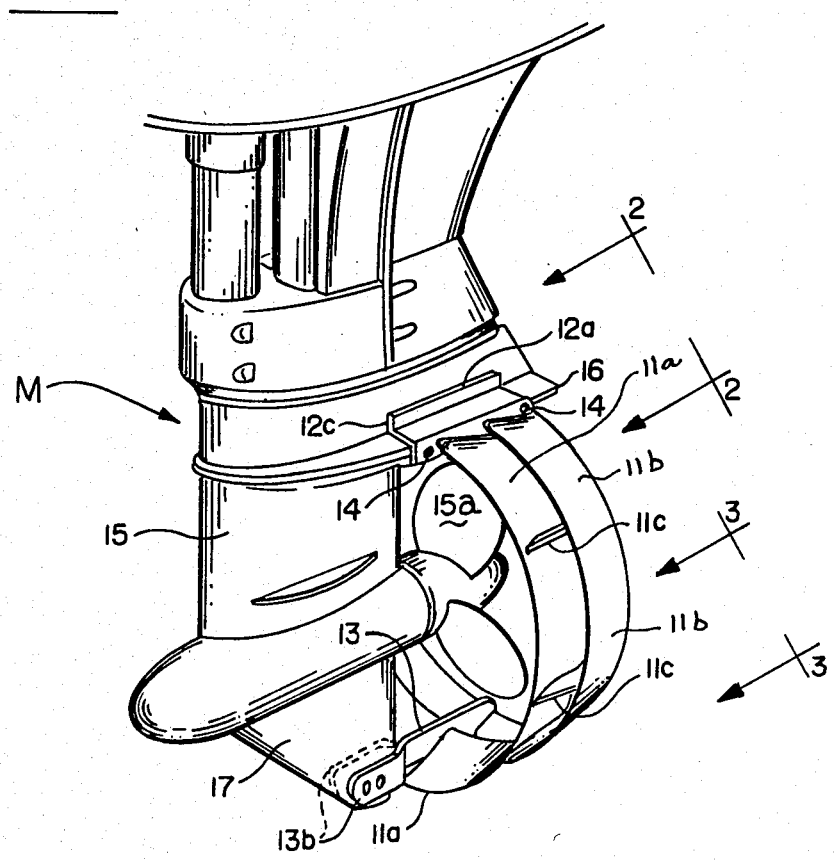
FIG. 1 is a perspective view showing a propeller duct constructed in accordance with one embodiment of the invention and attached to an outboard motor or to the stern drive of an inboard motor.
Figure 2:
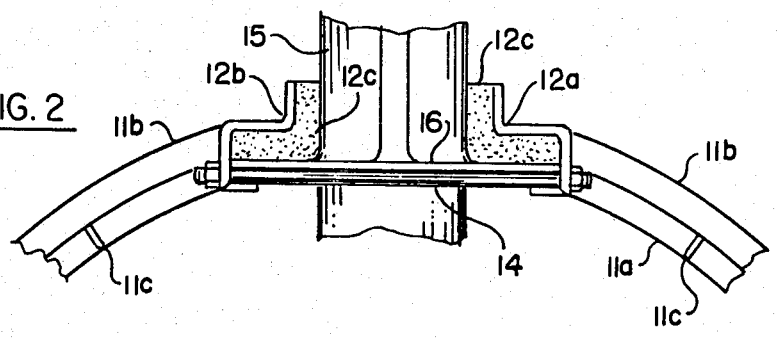
FIG. 2 is a rear view of the upper portion of the propeller duct of FIG. 1 taken substantially along the line 2—2 of FIG. 1.
Figure 3:
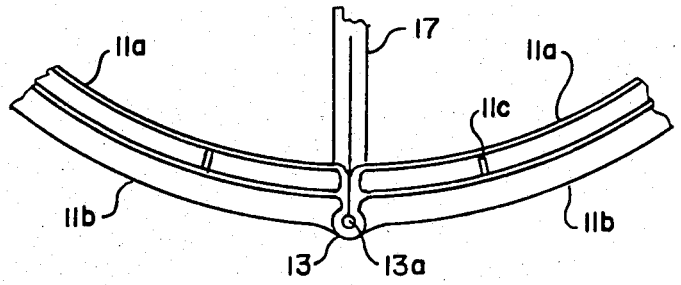
FIG. 3 is a rear view of the lower portion of the propeller duct of FIG. 1 taken substantially along the line 3—3 of FIG. 1.

As shown in FIGS. 1 through 4, the propeller duct constituting a first embodiment of the invention comprises a primary cowling 11*a* and a secondary cowling 11*b*. The cowlings 11*a* and 11*b* are coaxial with one another, and they are axially staggered as shown. The primary cowling 11*a* is provided with a series of axial vanes 11*c* which are angularly positioned around the cowling, and which serve to attach it to the secondary cowling 11*b* and which hold the cowlings spaced from one another.

The two cowlings 11*a*, 11*b* are hinged to one another by a hinge 13 at their lower extremities. Hinge 13 includes a hinge pin 13*a*. The upper extremities of the cowlings have fittings 12*a* and 12*b* contoured to receive resilient mounting pads 12*c*, as well as mounting screws 14. The mounting screws 14 attach the duct assembly to the anti-cavitation plate 16 of outboard motor, or inboard-outboard motor outdrive M.

The drive M has a shaft housing 15. A propeller 15*a* is rotatably mounted in the shaft housing. The lower end of the duct assembly is secured to a guide skeg 17 by a fork 13*b*, which is an extension of the lower cowling hinge 13. Skeg 17 is attached to the lower end of housing 15.

As best shown in FIG. 4, the primary cowling 11*a* and the secondary cowling 11*b* are positioned in relationship to one another in such a manner that the leading edge of the secondary cowling 11*b* extends over the trailing edge of primary cowling 11*a* by a fixed overlapping distance "E" to form an annular secondary water inlet coaxial with the axis of rotation of propeller 15*a*.

The leading edge of primary cowling 11*a* in the embodiment of FIGS. 1–4 is cylindrical, and, as mentioned above, it is concentric with the axis of rotation G of the propeller to guide the flow of secondary water into the secondary cowling and to prevent cavitation. Also, the trailing edge of the primary cowling is cylindrical and concentric with the axis G to control the flow of water in the annular space between the cowlings and to create a nozzle or Venturi effect.

The propeller duct assembly is positioned in relation with the propeller 15*a* in such a manner that the extremity of the propeller blade diameter A is aligned with the trailing edge and lies within the smallest diameter B of the primary cowling 11*a*, as shown in FIG. 4.

As also shown in FIG. 4, the angle of primary cowling 11*a* is designated $\alpha$ and the angle of secondary cowling 11*b* is designated $\beta$. The distance of the rear tip of primary cowling 11*a* from the axis G is designated B, and the distance of the rear tip of secondary cowling 11*b* from axis G is designated C. The leading tips of the cowlings 11*a* and 11*b* are the same distance D from axis G. The difference in distance of the trailing edges of the two cowlings (C-B) is designated F.

The increase in propeller thrust is equal to the ratio between the effective projected propeller area and the area of the trailing edge of the secondary cowling 11*b*. The nozzle effect, created through the cowlings 11*a* and 11*b* decreases the tendency of the propeller race to spread thus increasing the towing efficiency of the water craft particularly at high propeller slip during take-off, which is advantageous when the boat is used for water skiing purposes.

In the embodiment of FIG. 5, the cowlings are designated 18*a* and 18*b* and they have a square configuration. In addition, transverse bars 19 are provided across the assembly as an additional safety feature.

In the embodiment of FIG. 6, the primary and secondary cowlings 20*a* and 20*b* have a hexagonal configuration.

Figure 7:
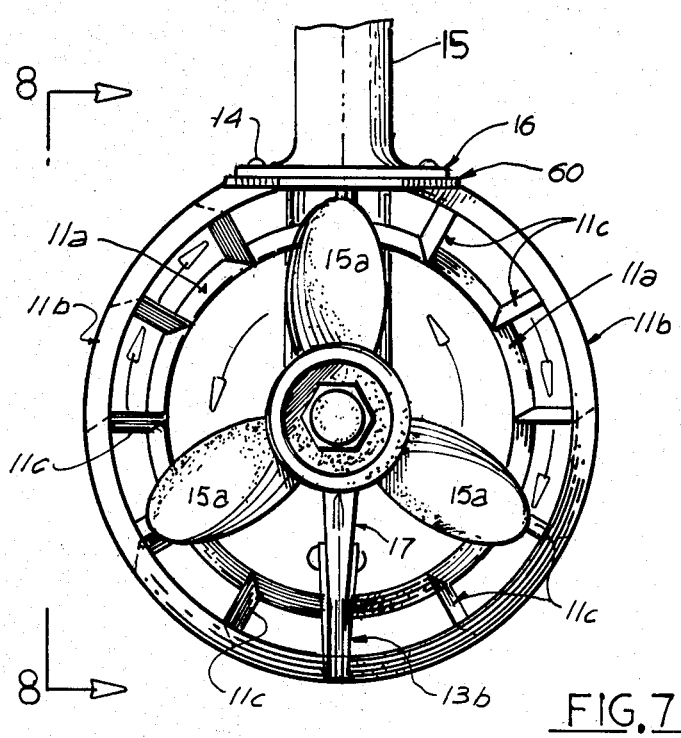
FIG. 7 is a rear elevational view of a propeller duct constructed in accordance with another embodiment.
Figure 8:
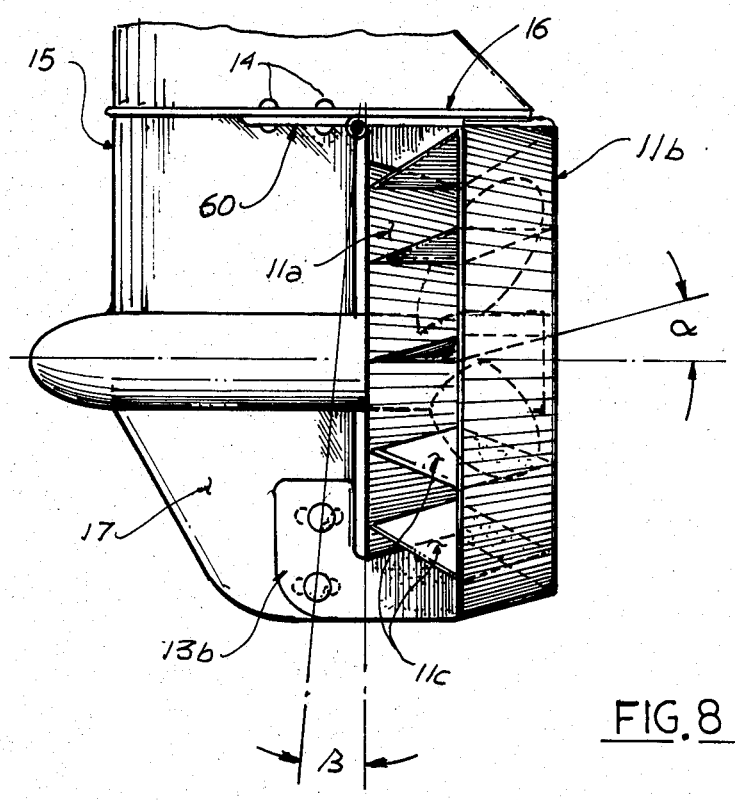
FIG. 8 is a sectional view taken along the lines 8—8 of FIG. 7.

In the embodiment of FIGS. 7 and 8, the vanes 11*c* between the primary and secondary cowlings 11*a* and 11*b* are positioned at selected angular positions with respect to the propeller axis so as to create a counter rotating vortex in relation with the propeller vortex and therefore providing an additional thrust-enhancing effect of a counter rotating propeller with straight jet stream-like back wash.

The assembly of FIGS. 6 and 7 is mounted to the anti-cavitation plate by a hinged mounting plate 60. This enables the propeller duct to be tilted with respect to the vertical axis of the propeller housing to provide a trip-tap function similar to the function performed by conventional trim drivers.

The fork 13*b* at the lower end of the duct is provided with a slot, as shown, to permit the assembly to be set to any desired tilted position.

Figure 9:
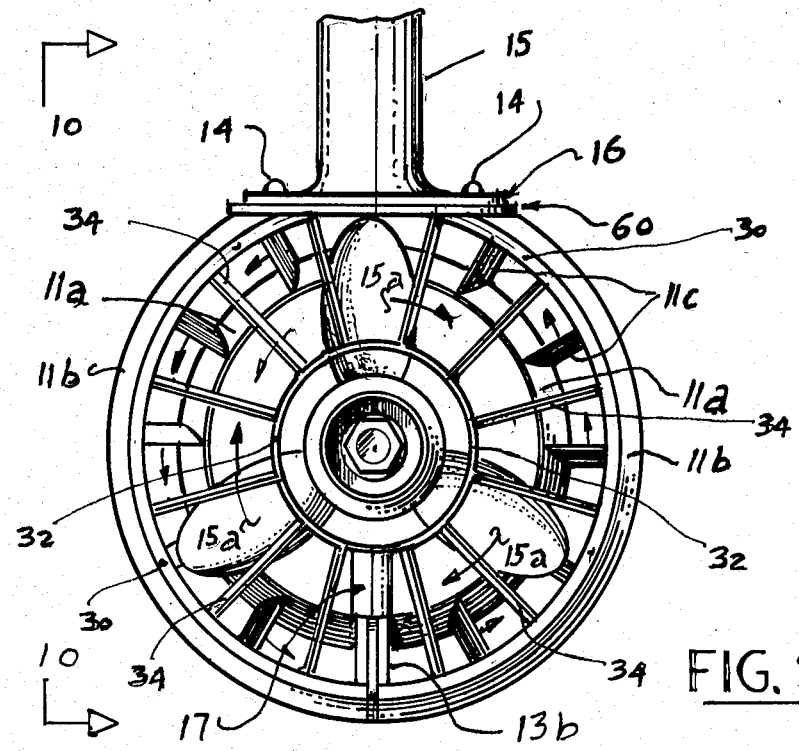
FIG. 9 is a rear elevational view of the assembly of FIG. 7 with a protective spider which is also constructed to enhance the thrust characteristics of the assembly.
Figure 10:
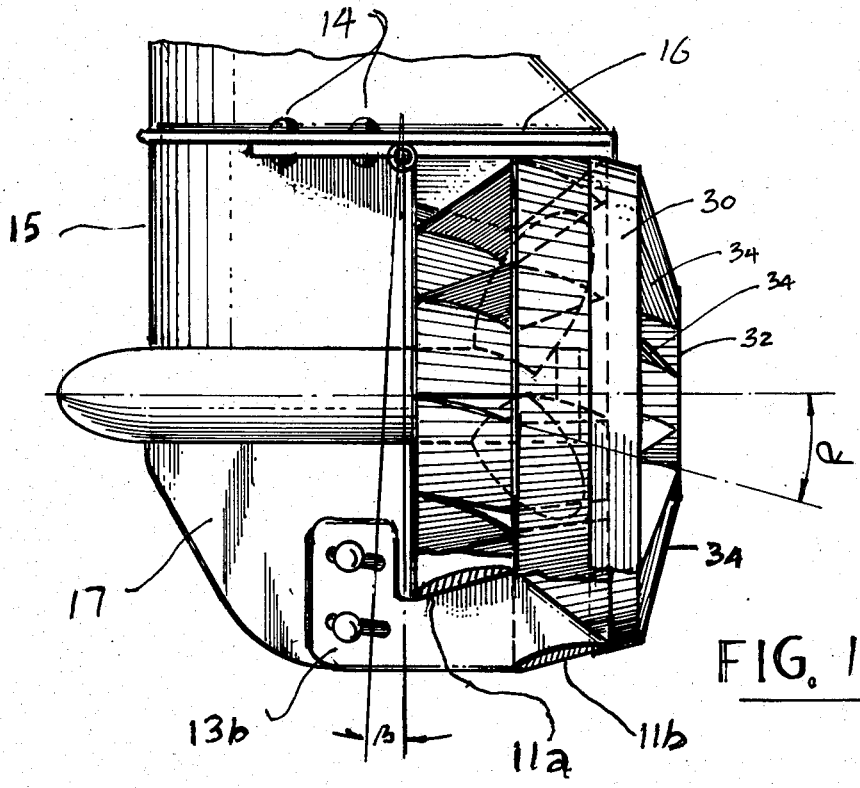
FIG. 10 is a sectional view taken along the lines 10—10 of FIG. 9.

In the embodiment of FIGS. 9 and 10, a protective guard is mounted to the rear of the assembly which has the form of a spider. The guard includes an outer ring 30 which is attached to the trailing edge of the propeller shroud by screws. The guard also includes an inner ring 32 which is held coaxial with the outer ring and with the axis of rotation of the propeller by a number of radial vanes or blades 34. Each of the blades 34 has a hydrofoil section, and the blades serve as thrust enhancers.

As the propeller rotates in a clockwise drection, as shown by the first set of arrows, the stator vanes or blades 11*c* and the blades 34 cause water vortex rotation in the counterclockwise direction, as shown by the second and third set of arrows.

The invention provides, therefore, an improved duct assembly for the propeller of a water craft, which not only enhances the thrust of the propeller, but also serves as a safety factor for swimmers, a protection for the propeller, to increase fuel efficiency, and to stabilize handling of the craft.

Although particular embodiments of the invention have been shown and described, modifications may be made, and it is intended in the claims to cover all modifications which come within the true spirit and scope of the invention.

What is claimed is:

1. A thrust-enhancing duct assembly mounted on the propeller housing of a water craft comprising: a primary cowling mounted on the housing coaxially with the axis of rotation of the propeller, at least a portion of the primary cowling extending forward of the propeller and beyond the plane thereof; a secondary cowling coaxially mounted with respect to the primary cowling and spaced axially therefrom in overlapping relationship therewith so that the leading edge of the secondary cowling extends over the trailing edge of the primary cowling and the trailing edge of the secondary cowling extends rearwardly beyond the plane of the propeller, the secondary cowling being spaced radially from the primary cowling to create an annular space between the primary and secondary cowlings, with the primary cowling controlling the flow of water into the annular space to create a venturi effect; a plurality of axial vanes secured to said primary cowling at spaced annular positions around the outer surface of said primary cowling and secured to the inner surface of said secondary cowling to hold said cowlings in spaced and coaxial relationship, said vanes being shaped and positioned to create a counter rotating vortex in relation with the propeller vortex.

2. The duct assembly defined in claim 1, in which said housing is equipped with a cavitation plate, and said primary cowling is mounted on said housing below said cavitation plate.

3. The duct assembly defined in claim 2, in which each of the primary and secondary cowlings are formed of two arcuate sections, and which includes hinge means attached to the housing for securing the arcuate sections at their lower extremity, and fastener means secured to the housing for securing the arcuate sections at their upper extremities.

4. The duct assembly defined in claim 3, in which the housing is also equipped with a guide skeg, and an anti-cavitation plate, and in which said hinge means is attached to said guide skeg and said fastener means is attached to said anti-cavitation plate.

5. The duct assembly defined in claim 4, in which said fastener means includes a hinge to permit the duct assembly to be tilted with respect to the vertical axis of the propeller housing.

6. The duct assembly defined in claim 1, in which the cowlings have a generally cylindrical configuration.

7. The duct assembly defined in claim 1, in which said cowlings have a generally square configuration.

8. The duct assembly defined in claim 1, in which said cowlings have a generally hexagonal configuration.

9. The duct assembly defined in claim 1, and which includes a protective guard mounted in the rear side of the duct assembly, said guard comprising an inner ring and an outer ring coaxial with the axis of rotation of the propeller, and a plurality of radial vanes interconnecting said inner and outer rings, said last-named vanes being shaped and positioned to create a counter rotating vortex in relation with the propeller vortex.

* * * * *